US011599037B2

(12) United States Patent
Hirai

(10) Patent No.: US 11,599,037 B2
(45) Date of Patent: Mar. 7, 2023

(54) IMAGE FORMING APPARATUS

(71) Applicant: Konica Minolta, Inc., Tokyo (JP)

(72) Inventor: Atsuto Hirai, Nara (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/490,494

(22) Filed: Sep. 30, 2021

(65) Prior Publication Data

US 2022/0107583 A1 Apr. 7, 2022

(30) Foreign Application Priority Data

Oct. 7, 2020 (JP) ..... JP2020-169937

(51) Int. Cl.

| | |
|---|---|
| ***B44C 1/00*** | (2006.01) |
| ***G03G 15/08*** | (2006.01) |
| ***G03G 15/00*** | (2006.01) |
| ***B41M 1/22*** | (2006.01) |
| ***B41M 7/02*** | (2006.01) |
| *B41F 19/00* | (2006.01) |
| *B41M 7/00* | (2006.01) |

(52) U.S. Cl.

CPC ..... *G03G 15/0808* (2013.01); *B41M 1/22* (2013.01); *B41M 7/02* (2013.01); *B44C 1/00* (2013.01); *G03G 15/0822* (2013.01); *G03G 15/607* (2013.01); *G03G 15/6585* (2013.01); *B41F 19/002* (2013.01); *B41M 7/00* (2013.01); *G03G 15/6582* (2013.01)

(58) Field of Classification Search

CPC ..... G03G 15/0808; G03G 15/0822; G03G 15/607; G03G 15/6585; G03G 15/6582; B41M 1/22; B41M 7/02; B41M 7/00; B44C 1/00; B41F 19/002

See application file for complete search history.

(56) References Cited

U.S. PATENT DOCUMENTS

2002/0031380 A1* 3/2002 Sato ..... G03G 15/2042 399/328
2018/0373175 A1* 12/2018 Fujita ..... G03G 15/2064

FOREIGN PATENT DOCUMENTS

JP H01-200985 A 8/1989
JP 2002278327 A * 9/2002 ..... G03G 15/20
JP 2013178452 A * 9/2013 ..... G03G 15/01

* cited by examiner

*Primary Examiner* — Yaovi M Ameh
(74) *Attorney, Agent, or Firm* — Lucas & Mercanti, LLP

(57) ABSTRACT

An image forming apparatus includes a conveyer that conveys a recording medium supporting an image; a softener that softens the image; and a powder applicator that applies powder to the surface of the softened image, in which the applied powder adheres to a range that is narrower in a width direction orthogonal to a conveyance direction of the recording medium conveyed by the conveyer than a maximum width of the image to be supported by the recording medium.

12 Claims, 16 Drawing Sheets

IMAGE FORMING APPARATUS

CROSS REFERENCE TO RELATED APPLICATIONS

The entire disclosure of Japanese Patent Application No. 2020-169937 filed on Oct. 7, 2020, is incorporated herein by reference in its entirety.

BACKGROUND

Technological Field

The present invention relates to an image forming apparatus.

DESCRIPTION OF RELATED ART

In recent years, in the on-demand printing market, demand for spot color printing, decorative printing including metallic printing and pearl printing, and high value-added printing has been increasing. In particular, there is a great demand for decorative printing, and various printing methods therefor are being studied.

For example, Japanese Patent Application Laid-Open No. H01-200985 discloses a method for decorating a toner image by forming the toner image, superposing a foil body including a colorant layer and an adhesive layer on the toner image, and heating and pressuring the superposed foil body on the toner image, thereby decorating the toner image with the use of welding of the toner from heating. Japanese Patent Application Laid-Open No. H01-200985 also discloses that foil transfer is possible without causing wrinkles on the foil body.

SUMMARY

From the studies performed by the present inventors, it was found that the foil body is applied to the region where the toner image has been formed in the method of Japanese Patent Application Laid-Open No. H01-200985, and thus applying the foil body only to a region desired to be decorated was difficult when this portion is only a part of the toner image.

The present invention has been made in view of the above point, and an object of the present invention is to provide an image forming apparatus capable of performing decoration to give metallic luster only in a desired region of an image.

To achieve at least one of the abovementioned objects, according to an aspect of the present invention, an image forming apparatus reflecting one aspect of the present invention includes a conveyer that conveys a recording medium supporting an image; a softener that softens the image; and a powder applicator that applies powder to the surface of the softened image. In the image forming apparatus, the applied powder adheres to a range that is narrower in a width direction orthogonal to a conveyance direction of the recording medium conveyed by the conveyer than a maximum width of the image to be supported by the recording medium.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Embodiment 1

Configuration of Image Forming Apparatus

Figure 1:
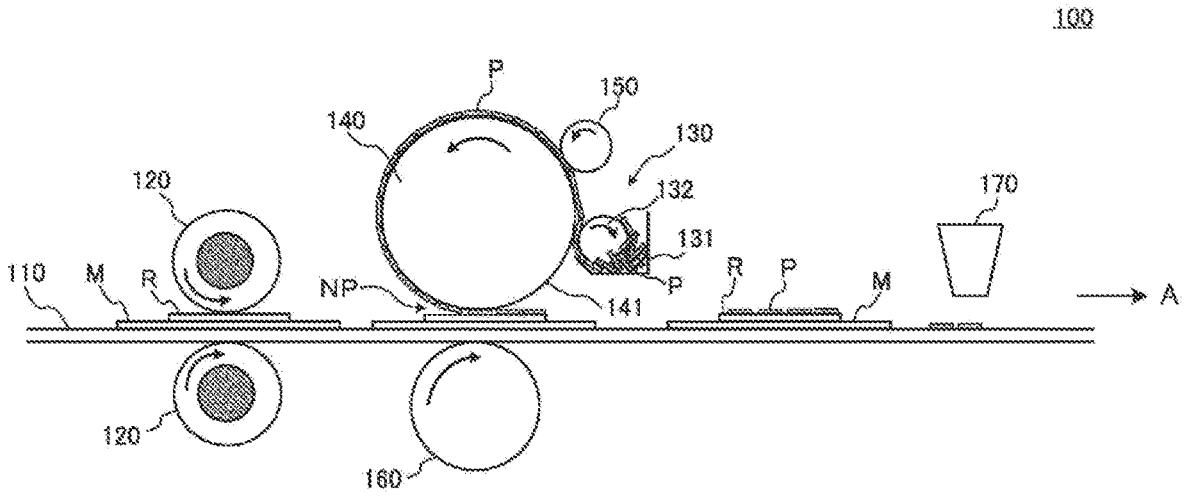
FIG. 1 is a schematic diagram of an overall configuration of an image forming apparatus according to Embodiment 1.
Figure 2:
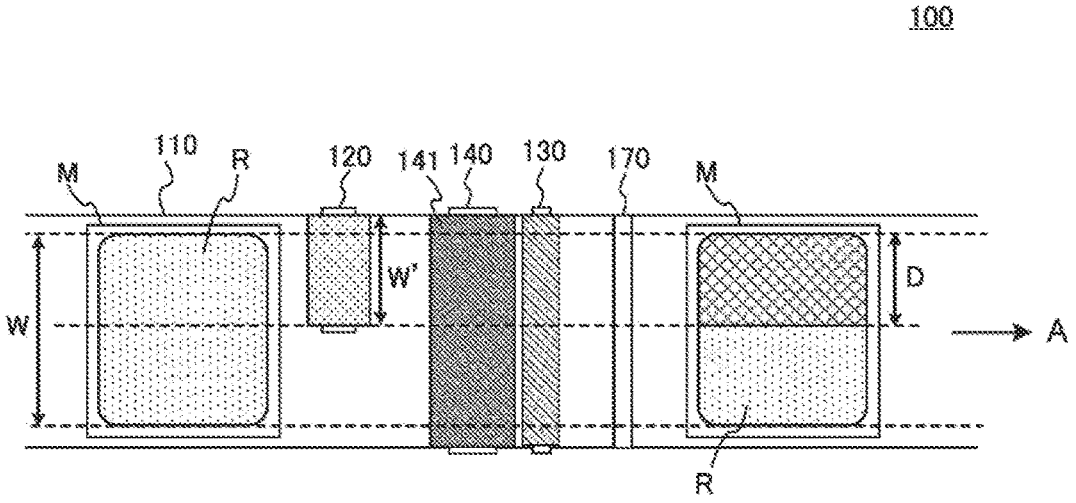
FIG. 2 is a plan view of the image forming apparatus according to Embodiment 1.

FIG. 1 is a schematic diagram of an overall configuration of image forming apparatus 100 according to Embodiment 1. FIG. 2 is a plan view of image forming apparatus 100 according to Embodiment 1.

Image forming apparatus 100 supplies powder P to image R supported on the surface of recording medium M to allow powder P to adhere to image R, thereby forming a decorated image with powder P adhering to the surface of image R.

As illustrated in FIG. 1, image forming apparatus 100 includes conveying section 110 for conveying recording medium M, on which image R is formed, in conveyance direction A; softening section 120 for softening image R; powder supply section 130 that supplies powder P; powder applying section 140 that attaches powder P, supplied from powder supply section 130, to powder holding surface 141 for temporarily holding powder P to convey powder P, and applies powder P to image R; rubbing section 150 that aligns powder P supplied on the surface of powder applying section 140 from powder supply section 130 to powder applying section 140; opposing member 160 which is provided at a position facing powder holding surface 141 of powder applying section 140 with recording medium M between opposing member 160 and powder holding surface 141, and which forms nip section NP between opposing member 160 and powder applying section 140, thereby pressurizing recording medium M and powder P at nip section NP; and powder collecting section 170 that collects powder P adhering to conveying section 110 and a region other than image R on recording medium M.

In the present embodiment, image R is an image which is formed of a thermoplastic resin such as toner or ink, and which is formed on the surface of recording medium M. In the present embodiment, powder P is supplied from powder supply section 130 to powder applying section 140, and to image R softened by softening section 120, thereby adhering powder P to the surface of softened image R to produce an decorated image in which image R is decorated by powder P.

In addition, powder P is an aggregate of powder particles in the present embodiment. Examples of the powder particles include metal particles, resin particles, particles containing a thermoresponsive material, magnetic particles, and non-magnetic particles. Powder P, for example, is preferably powder particles containing metal powder or metal oxide powder when a metallic-like decorating effect is desired. The powder particles may contain two or more different materials. The powder particle may be in the shape of a spherical particle or a non-spherical particle. The powder may be a synthesized product or a commercially available product. The powder may be a mixture of two or more different powder particles. It should be noted that the powder is not a toner.

The powder particle may be coated. The metal particle may be a particle of a metal coated with a different metal, a metal oxide or a resin, or a metal or a metal oxide coating the surface of a resin, glass, or the like. The metal particle may be a metal oxide particle, or may be a metal oxide particle coated with a different metal oxide, a metal or a resin. Alternatively, the metal particle may be a particle obtained by extending a metal or a metal oxide into a plate shape and pulverizing the resultant, coating such a particle with any of various materials, or vapor-depositing or wet-coating the metal or metal oxide on a film or glass. For obtaining a metallic image, the powder particle preferably contains a metal or a metal oxide, and a content of the metal or the metal oxide is preferably 0.2 wt % to 100 wt %.

From the viewpoint of aligning the powder along the powder holding surface before transferring the powder to the surface of an image, the powder particles preferably have a shape that is not spherical (non-spherical powder), for example, a flat particle shape. The term "flat particle shape" means a shape having a ratio of a short diameter to a thickness of 5 or more, when a maximum length of a powder particle is referred to as a long diameter, a maximum length in a direction orthogonal to the long diameter is referred to as the short diameter, and a minimum length in the orthogonal direction is referred to as the thickness.

The thickness of the powder particle is preferably 0.2 to 10 μm, and more preferably 0.2 to 3.0 μm, from the viewpoint of fully developing the appearance effect of the adhesion of the aligned powder. When the thickness of the powder particle is too small, a suitable aligning state of the powder particles may not be sufficiently formed—the suitable aligning state means the plane direction of the powder particle, which includes the long and short diameter directions of the powder particle adhered to the surface of a resin layer, is substantially along the surface direction of the above resin layer. When the thickness is too large, the powder may be removed when the image is rubbed.

Examples of commercially available powder include MetaShine (manufactured by Nippon Sheet Glass Co., Ltd., their registered trademark). Sunshine Babe, Chrone Powder, Aurora Powder and Pearl Powder (all manufactured by GG Corporation Inc.). ICEGEL Mirror Metal Powder (manufactured by TAT Inc.), Pica Ace MC Shine Dust and Effect C (manufactured by Kabushiki Kaisha Kurachi, "Pica Ace" being their registered trademark), PREGEL Magic Powder, Mirror Series (manufactured by Yugen Kaisha Preanfa, "PREGEL" being their registered trademark), BONNAIL Shine Powder (manufactured by K's Planning Co., Ltd., "BONNAIL" being their registered trademark), ELgee neo (manufactured by Oike & Co., Ltd., their registered trademark), Astroflake (manufactured by Nihonboshitsu Co., Ltd.), and Aluminum Pigment (manufactured by Toyo Aluminum K.K.).

The thermoresponsive material is a material that undergo changes in shape, such as expansion, contraction, and deformation, and/or changes in color, such as color development, decolorization or discoloration, triggered by thermal stimuli. Examples of the particle containing a thermoresponsive material include a thermally expandable microcapsule and a temperature-sensitive capsule. Examples of the thermally expandable microcapsule include Matsumoto Microsphere (manufactured by Matsumoto Yushi-Seiyaku Co., Ltd.) and Kureha Microsphere (manufactured by Kureha Corporation). An example of the temperature-sensitive capsule is a temperature-sensitive dye capsule (manufactured by Japan Capsular Products Inc.).

An aggregate of metal particles is used as powder P in the present embodiment.

In the present embodiment, recording medium M is not particularly limited as long as an image can be formed on its surface (main surface). Examples of the recording medium include normal paper ranging from thin paper to cardboard, wood-free paper, coated print sheets such as art paper and coated paper, commercially available Japanese paper and postcard sheets, plastic films, resin films, and fabrics. The shape and color of the recording medium are not limited either, and can be selected according to a decorated image to be formed.

Conveying section 110 is a device for conveying recording medium M, which includes image R supported on its surface, to powder applying section 140. An example of transport unit 110 is a conveyor belt.

Softening section 120 softens image R in a range that is narrower than the maximum width (W) of image R that recording medium M can support (hereinafter simply referred to as the "maximum width (W) of image R") as illustrated in FIG. 2. In the present embodiment, softening section 120 heats recording medium M, which is placed so that image R is on the powder applying section 140 side, by a contact method such as a heat roller in such a way that the resin constituting image R is heated and softened (melted), thereby softening image R. Softening section 120 may heat image R in an oven to soften (melt) the resin constituting image R, thereby softening image R. Alternatively, softening section 120 may heat image R by a non-contact method such as a halogen lamp, warm air blower, or the like. When image R is at a higher temperature, softening section 120 may cool image R to a temperature suitable for decoration, or may soften image R by applying, for example, chemicals.

As illustrated in FIG. 2, softening section 120 has a width (W') that is smaller than the maximum width (W) of image R in the width direction. The width (W') of softening section 120 may be any value that is smaller than the maximum width (W) of image R. The width (W') may be changed in accordance with a region (D) where powder P is desired to be adhered in the surface of image R. The width of image R to be softened by softening section 120 (i.e., the range to be softened in image R. or the region (D) where powder P is to be adhered) is preferably 10% or more and 90% or less of the maximum width (W) of image R, more preferably 20% or more and 60% or less. By setting the region (D), where powder P is to be adhered, to 10% or more of the maximum width (W) of image R, the decorated region including powder P adhering thereto can be made to stand out, and by setting the region (D) to 90% or less, not the entire image R appears to be decorated.

In FIG. 1, two softening sections 120 are disposed with conveying section 110 therebetween so that image R can be heated from above and below, but the heating method is not limited to this configuration. For example, softening section 120 may be disposed only on the back side of conveying section 110.

Powder supply section 130 supplies powder P to powder holding surface 141 of powder applying section 140. Powder supply section 130 includes storage container 131 for storing powder P and conveying member 132 housed in storage container 131. Powder supply section 130 may be provided with a scattering prevention member for preventing powder P from falling or scattering, or a collecting member for sucking powder P by air suction (both not shown).

Storage container 131 includes an opening disposed along the axial direction of powder holding surface 141 of powder applying section 140 that has a cylindrical shape.

Conveying member 132 is a rotatable cylindrical brush or sponge and rotates inside storage container 131 in the direction opposite to that of powder applying section 140, thereby conveying powder P stored in storage container 131 to the opening of storage container 131 and supplying powder P to powder holding surface 141 of powder applying section 140.

Powder applying section 140 is a cylindrical member that is rotated by a drive motor about a cylindrical shaft in a direction along conveyance direction A of recording medium M. The circumferential surface having a cylindrical shape in powder applying section 140 serves as adhesive powder holding surface 141. Powder applying section 140 holds powder P on the above-described adhesive powder holding surface 141 by adhesion and conveys powder P to nip section NP. In the present embodiment, powder applying section 140 is a cylindrical member in which a silicone rubber "RBAM2-100" (manufactured by MISUMI Group Inc.) having a thickness of 2 mm and a Shore A hardness of 53 is placed on the surface of a roller having an outer diameter of 100 mm.

Powder holding surface 141 preferably has an adhesive force (also referred to as adhesion force) of 28 kPa or more. Powder holding surface 141 preferably has an adhesive force such that when adhered powder P comes into contact with softened image R, powder P is transferred from powder holding surface 141 to image R. From this viewpoint, the adhesive force of powder holding surface 141 is preferably 470 kPa or less, and more preferably 350 kPa or less. Examples of materials constituting such powder holding surface 141 include fluororubber, silicone rubber, and urethane rubber. The material constituting powder holding surface 141 is not limited to the rubber materials, and may be another material such as a resin material or metal material that has an adhesive force capable of holding the powder.

The adhesive force can be measured by using a tackiness tester "FSR-1000" (manufactured by RHESCA Co., LTD.). The adhesive force can be measured as the force required when a tip of a probe is pressed against the sample surface and pull the tip off. For example, the adhesive force can be measured under the following conditions. The adhesive force can be converted to pressure based on the area of the probe tip.

Measurement Condition (1) Probe diameter: Diameter 10 mm
(2) Pressing speed 5 mm/sec
(3) Pressing pressure: 50 kPa
(4) Pressing and holding time 1 second
(5) Probe pulling speed: 5 mm/sec
(6) Measurement temperature: 20° C.

Powder applying section 140 is disposed downstream of softening section 120 on conveying section 110 for recording medium M and on the side of the main surface where image R is formed on recording medium M. When softening section 120 softens image R by heating, the heat from image R is also transmitted to powder applying section 140, so the material constituting powder holding surface 141 preferably has heat resistance. From this viewpoint, silicone rubber is preferred among the rubber materials described above.

Powder applying section 140 that attaches powder P to image R does not move and is disposed at a predetermined position. Powder applying section 140 applies powder P to the surface of image R supported on the surface of recording medium M that is conveyed to powder applying section 140 by conveying section 110.

Rubbing section 150 is disposed downstream of powder supply section 130 in the rotation direction of powder applying section 140, and nibs powder holding surface 141 of powder applying section 140 by rotating about a cylindrical shaft while in contact with powder holding surface 141. Rubbing section 150 may have a shape of, for example, a cylinder, an elliptical cylinder, or polygonal cylinder, and preferably have a shape of a cylinder.

Rubbing section 150 rubs powder holding surface 141 of powder applying section 140 by rotating in the same direction as powder applying section 140 while in contact with powder holding surface 141. The circumferential surface of rubbing section 150 that rubs powder holding surface 141 is preferably made of a material having voids for accommodating powder P. Examples of such materials include porous materials such as brushes, sponges and non-woven fabrics. Rubbing section 150 having voids rubs powder holding surface 141 of the rotating powder applying section 140 can capture excess powder P that has not adhered to powder holding surface 141 in the above voids and remove the powder. From the above viewpoint, rubbing section 150 may include a powder collecting section (not shown) for collecting the removed powder. The powder collecting section may be of an air suction type, or may have a configuration such that a member in the form of a roller or blade is brought into contact with the circumferential surface of rubbing section 150 and powder P is ejected from the above voids by the restoring force of the material constituting the circumferential surface of rubbing section 150.

Rubbing section 150 is configured to rotate about a cylindrical shaft and can continue to convey powder P captured and accommodated in the voids in the rotation direction. Therefore, powder P is not accumulated at nip section NP between powder holding surface 141 and rubbing section 150, and excess powder P can be removed from powder holding surface 141. This configuration can stabilize the rubbing property of rubbing section 150 relative to powder holding surface 141.

The rubbing by the use of rubbing section 150 leaves one layer of powder P directly adhering to powder holding surface 141. When powder P is non-spherical, the directionality of powder P with respect to powder holding surface 141 can also be oriented (aligned) by the rubbing with rubbing section 150. This configuration can transfer powder P from powder holding surface 141 to image R in an aligned manner. In particular, when powder P is metal particles or metal oxide particles, the aligning of powder P transferred to image R can enhance the luster of the decorated image. When powder P is aligned, the contact area between image R and powder P increases, and thus powder P becomes less likely to peel off from image R.

During the rubbing, as the direction of the rotation of rubbing section 150 is the same as the rotation direction of powder applying section 140, the relative speed (rubbing speed) of rubbing section 150 to powder applying section 140 increases, thereby increasing the rubbing effect. However, as long as powder holding surface 141 can be rubbed due to the relative speed difference with the rotating powder applying section 140, rubbing section 150 does not have to rotate, or rubbing section 150 may rotate at a different speed in the direction opposite to that of powder applying section 140.

The pressing force of rubbing section 150 against powder holding surface 141 of powder applying section 140 is preferably 1 kPa or more and 10 kPa or less, and more preferably 1 kPa or more and 5 kPa or less. A pressing force of 1 kPa or more of rubbing section 150 enables stable rubbing of powder holding surface 141 of powder applying section 140. A pressing force of 10 kPa or less prevents unevenness in driving of rubbing section 150 due to excessive torque for rotating rubbing section 150 and/or prevents material deterioration of rubbing section 150 and powder applying section 140.

Opposing member 160 presses recording medium M and powder applying section 140 against each other at nip section NP to cause powder P held on powder holding surface 141 of powder applying section 140 to be transferred to image R formed on the main surface of recording medium M. Image R has been softened by softening section 120 to develop adhesiveness, and thus powder P is transferred by the pressure generated when recording medium M passes through nip section NP.

Powder collecting section 170 collects excess powder P, which is applied from powder applying section 140 to recording medium M or conveying section 110 but is not adhered to be held on image R, at nip section NP Powder collecting section 170 is disposed downstream of nip section NP in the conveyance direction of recording medium M conveyed by conveying section 110 and on the side of the front surface (main surface) where image R is formed on recording medium M.

Powder collecting section 170 may have, for example, a configuration for sucking powder P by air suction but the configuration is not limited thereto.

Transferability of Powder P to Surface of Image R

Figure 3:
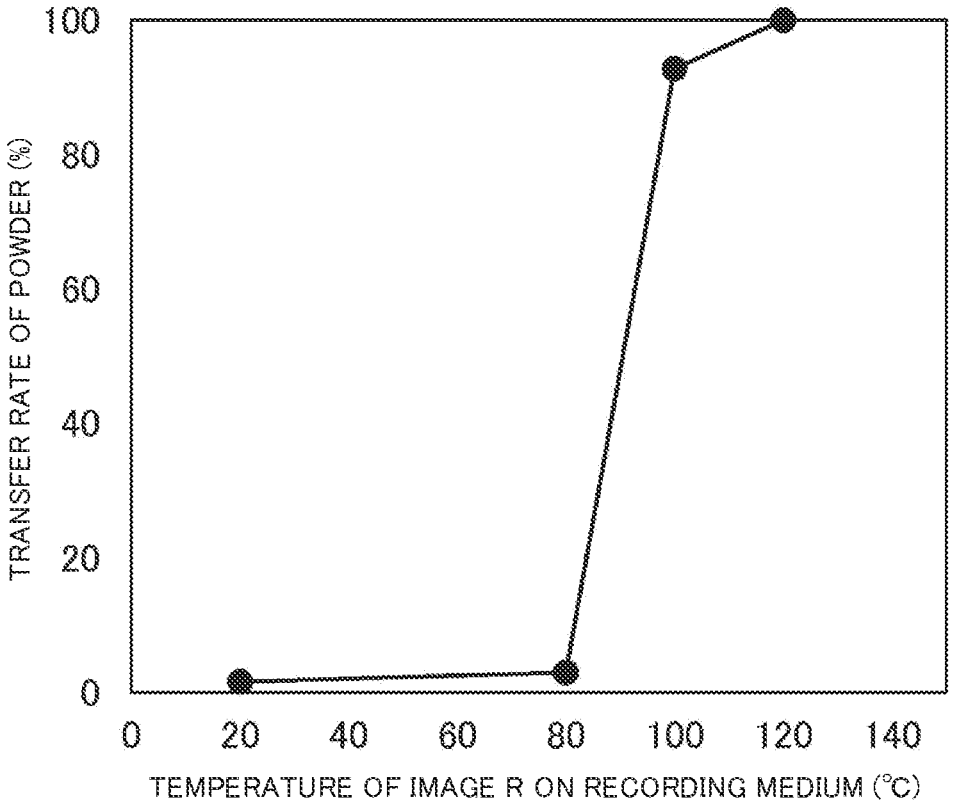
FIG. 3 is a graph showing the relationship between the change in temperature of an image supported on the surface of a recording medium and the transferability of the powder applied from a powder applying section to the image.

FIG. 3 is a graph showing relationship between the change in temperature of image R (herein, a toner image) supported on the surface of recording medium M and the transferability of powder P applied from powder applying section 140 to image R.

Used as powder applying section 140 is a silicone rubber "RBAM2-100" (manufactured by MISUMI Group Inc.) having a thickness of 2 mm, a Shore A hardness of 53, and an adhesive force of 82 kPa on the surface of a roller having an outer diameter of 100 mm. After applying powder P (ELgee neo #325) to the surface of powder applying section 140, the surface of powder P is rubbed with rubbing section 150 (RUBYCELL U4A1 having an outer diameter of 20 mm and a thickness of 3 mm, manufactured by TOYOPOLYMER CO., LTD., "RUBYCELL" being their registered trademark). The adhesion state of powder P applied to the surface of powder applying section 140 is observed by using a digital microscope "VFX-6000" (manufactured by Keyence Corporation) at a magnification of 200 times. The captured image is subjected to a binarization processing by using the image processing software attached to the digital microscope, and the area ratio of powder P in image R is calculated.

As recording medium M. OK TopKote (basis weight 157 $g/m^2$, manufactured by Oji Paper Co., Ltd.) is used, and image R (black solid image) is formed on the surface of recording medium M by using Accurio Press C2060 (manufactured by KONICA MINOLTA, INC.) Powder applying section 140 and image R (black solid image) formed on the surface of recording medium M are heated, and then pressurized at a pressure of 200 kPa for 0.5 seconds. Subsequently, recording medium M and powder applying section 140 are separated. The state of powder P adhering to the surface of image R (solid black image) after the separation is observed with the digital microscope described above, and the area ratio of powder P in the image is calculated. The area ratio of powder P on the surface of the image is then divided by the area ratio of powder P on the surface of powder applying section 140 to obtain the transfer rate of powder P.

As illustrated in FIG. 3, when the temperature of image R is 20 to 80° C., powder P does not adhere to the surface of image R, but when the temperature reaches 100° C. or higher, the adhesiveness of image R is developed and powder P begins to adhere to the surface of image R. This result shows that the range of image R to be decorated can be adjusted by heating a region of image R, where powder P is desired to be adhered, to a certain temperature (e.g. 100° C.) or higher, and keeping a region of image R, where powder P is not desired to be adhered, to a certain temperature or lower (e.g. 20° C.).

Figure 4A:
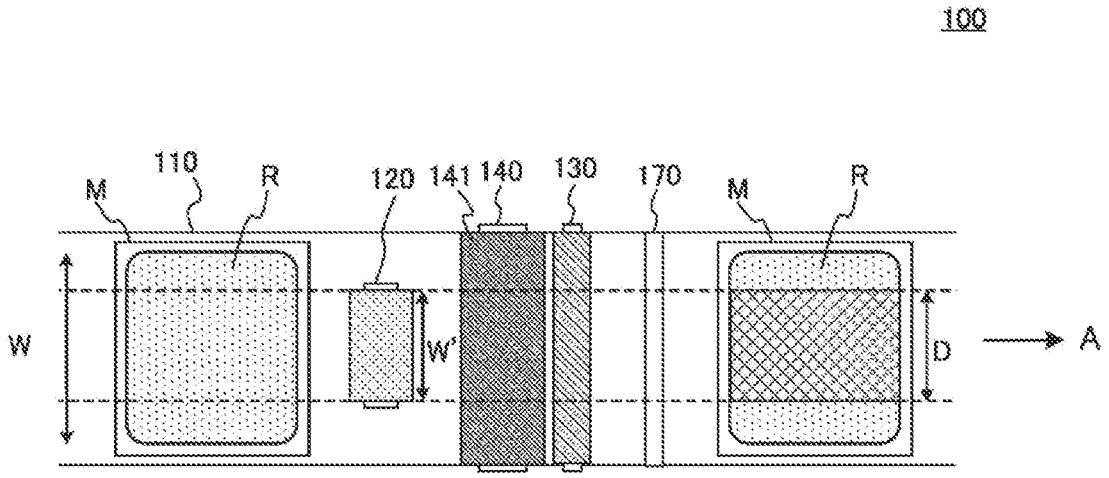
FIGS. 4A and 4B are plan views of the image forming apparatus according to Embodiment 1.
Figure 4B:
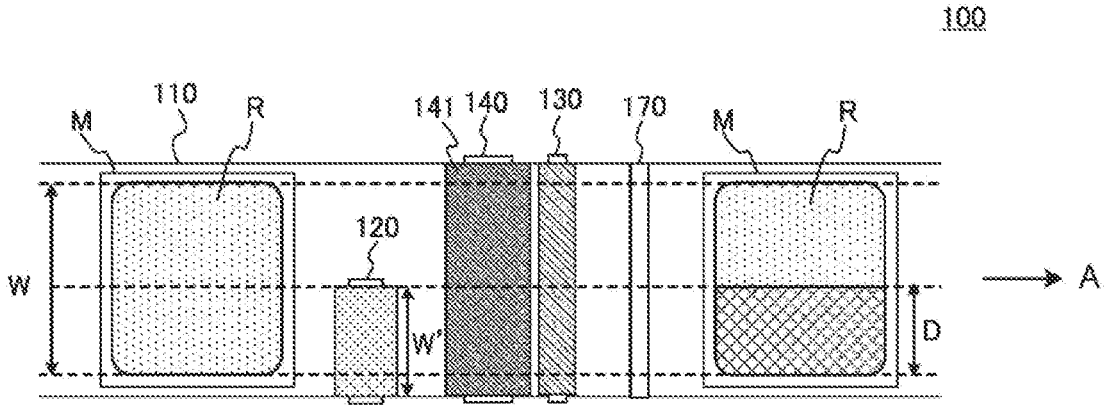
Figure 5:
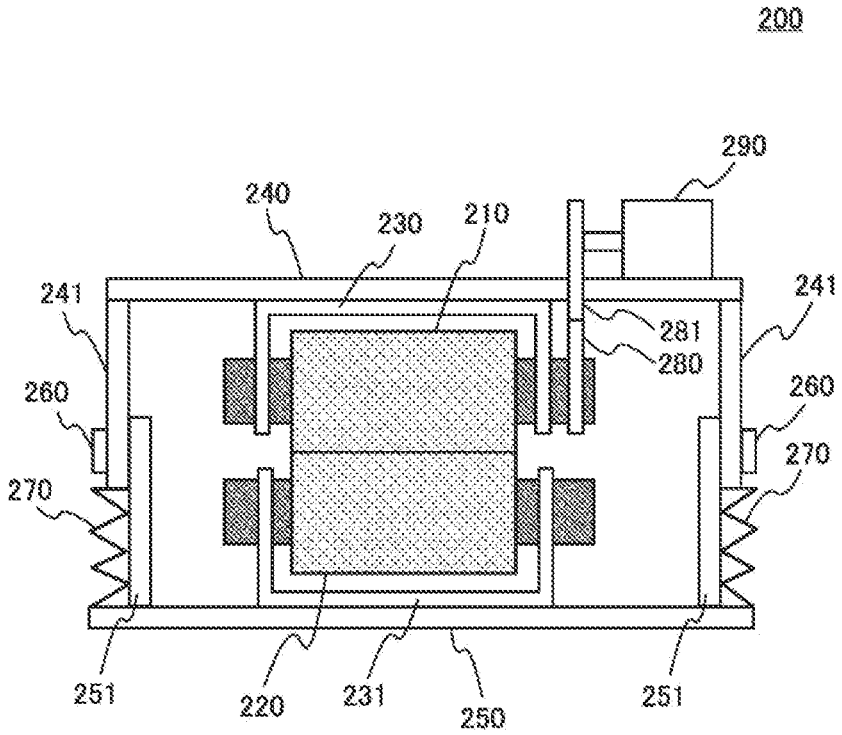
FIG. 5 is a front view showing the configuration of the roller unit.

In addition, the position of softening section 120 for softening image R (the region (D) where powder P is to be adhered) in the width direction can be changed in image forming apparatus 100 according to Embodiment 1 as illustrated in FIGS. 4A and 4B. For example, when softening section 120 is composed of roller unit 200 as shown in FIG. 5, the position of softening section 120 can be changed or moved by moving the positions of the heat roller and pressure roller (both described below) in roller unit 200.

Roller unit 200 includes heat roller 210 and pressure roller 220. Heat roller 210 and pressure roller 220 are attached to holding frames 230 and 231 via bearings (not shown), respectively. Heat roller 210 and pressure roller 220 each include a hollow core metal, and a heating member such as a halogen lamp (not shown) is disposed in the above hollow portion. Holding frame 230 is fixed to upper support plate 240, and holding frame 231 is fixed to lower support plate 250. Upper side plates 241 are disposed at both ends of upper support plate 240, and lower side plates 251 are disposed at both ends of lower support plate 250. Upper side plate 241 and lower side plate 251 are rotatably coupled by rotating pin 260. Pressure spring 270 is disposed at the lower end of upper side plate 241, and the force of pressure spring 270 presses heat roller 210 against pressure roller 220. Gear 280 is attached to one end of heat roller 210 and connects heat roller 210 with gear 281 fixed to drive motor 290, thereby rotating heat roller 210. Pressure roller 220 may be driven by heat roller 210. A hole (not shown) is provided in upper support plate 240 to allow gear 281 fixed to drive motor 290 to pass through, allowing gear 281 to connect to gear 280 attached to heat roller 210.

When roller unit 200 is used as softening section 120, the region of image R to be softened (the region (D) where powder P is to be adhered) can be changed by changing the attaching positions of holding frames 230 and 231 with respect to upper and lower support plates 240 and 250, and the attaching position of drive motor 290. In addition, when drive motor 290 is attached to holding frame 230, the region of image R to be softened can be changed by changing the attaching positions of the holding frames.

Figure 6A:
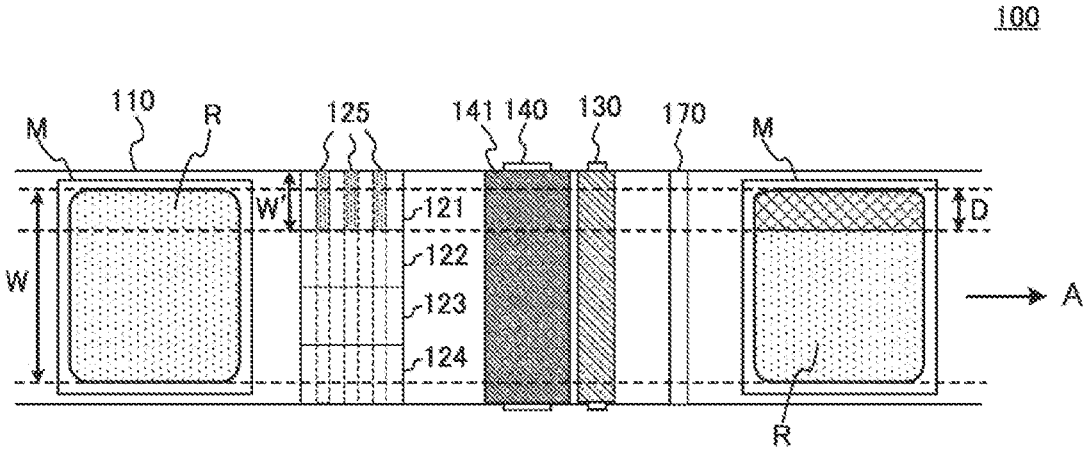
FIGS. 6A to 6C are plan views of an image forming apparatus according to a modification of Embodiment 1.
Figure 6B:
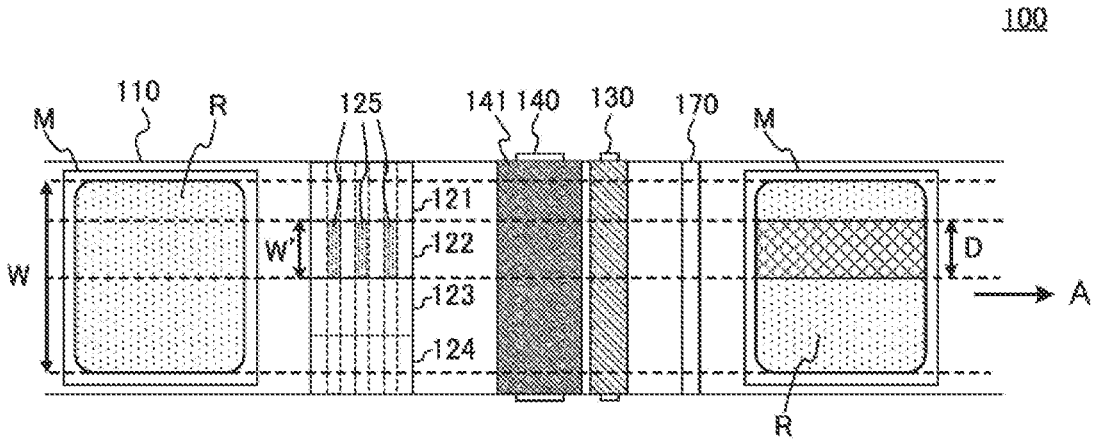
Figure 6C:
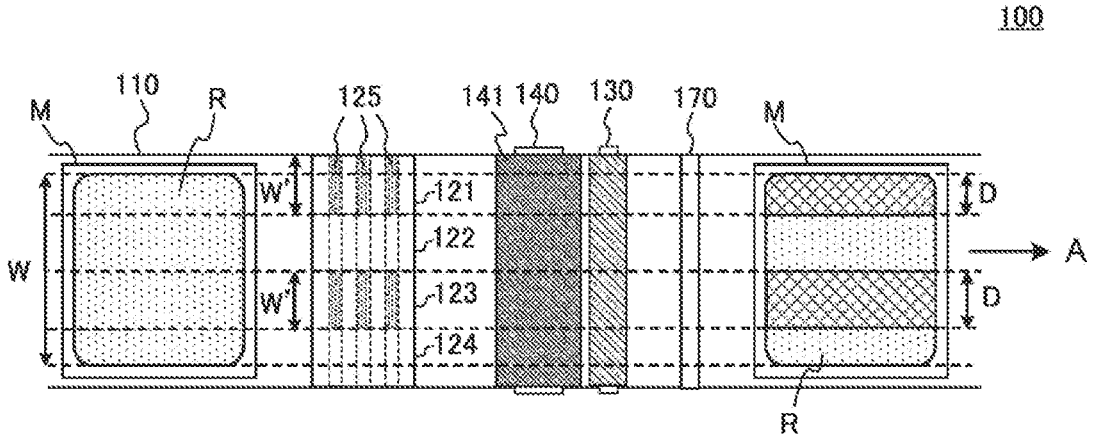

Alternatively, image forming apparatus 100 according to Embodiment 1 may include a plurality of softening sections 121 to 124 disposed at different positions in the width direction as illustrated in FIGS. 6A to 6C. Softening sections 121 to 124 may have any width (W') as long as each width is smaller than the maximum width (W) of image R. Four softening sections 121 to 124 are disposed in FIGS. 6A to 6C, but the number is not limited thereto. In addition, softening sections 121 to 124 each include heating member 125. For example, a halogen lamp and a reflector can be used as heating member 125. A plurality of halogen lamps may be disposed.

Effect

According to Embodiment 1 configured as described above, a range that is narrower than the maximum width (W) of image R, which recording medium M can support, can be decorated by using softening section 120 having a width (W') smaller than the maximum width (W) of image R in the width direction. By changing the disposing position of softening section 120 in the width direction, or using a plurality of softening sections 120 at different disposing positions, a range to be decorated can be set as desired in image R.

Embodiment 2

Configuration of Image Forming Apparatus

Figure 7:
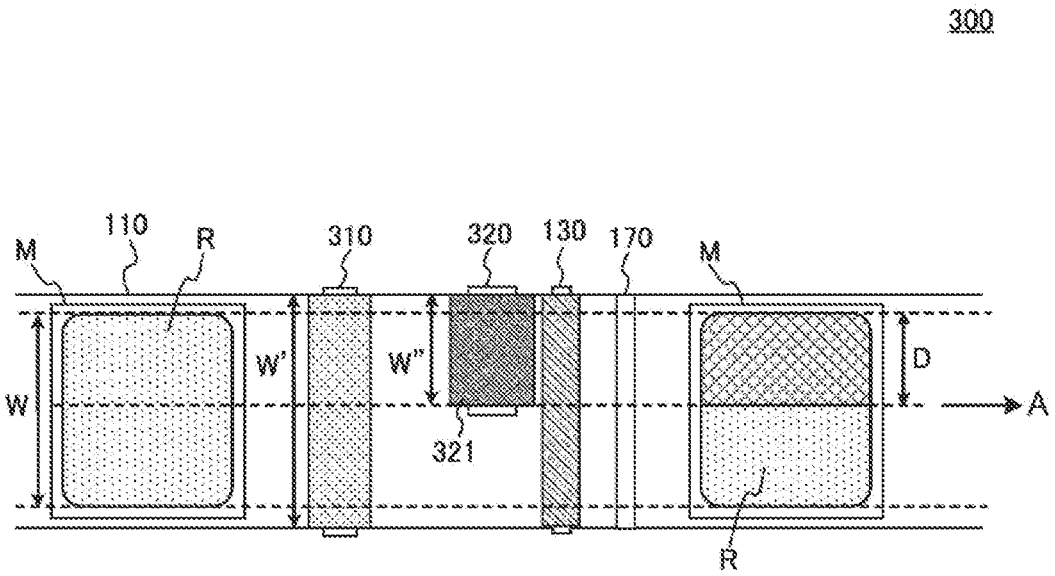
FIG. 7 is a plan view of an image forming apparatus according to Embodiment 2.

FIG. 7 is a plan view of image forming apparatus 300 according to Embodiment 2.

In image forming apparatus 300 according to Embodiment 2, the size of softening section 310 in the width direction in conveyance direction A and the size of powder applying section 320 in the width direction in conveyance direction A are different from those of Embodiment 1. Therefore, the same components as those of image forming apparatus 100 according to Embodiment 1 are designated by the same reference numerals, and the description thereof will be omitted.

As illustrated in FIG. 7, image forming apparatus 300 includes conveying section 110 that conveys recording medium M supporting image R in conveyance direction A: softening section 310 that softens image R; powder supply section 130 that supplies powder P; powder applying section 320 that attaches powder P, supplied from powder supply section 130, to powder holding surface 321 to convey powder P, and applies powder P to image R; rubbing section 150 (not shown) that aligns powder P, supplied from powder supply section 130 to powder applying section 320, on the surface of powder applying section 320; opposing member 160 (not shown) which is provided at a position facing powder holding surface 321 of powder applying section 320 with recording medium M between opposing member 160 and powder holding surface 321, and which pressurizes recording medium M and powder P between opposing member 160 and powder applying section 320; and powder collecting section 170 that collects powder P adhering to conveying section 110 and a region other than image R on recording medium M.

As illustrated in FIG. 7, softening section 310 has a width (W') larger than the maximum width (W) of image R in the width direction.

Powder applying section 320 has a width (W") that is smaller than the maximum width (W) of image R. Powder P adheres to powder holding surface 321 of powder applying section 320 in a range that is narrower than the maximum width (W) of image R in the width direction orthogonal to conveyance direction A of recording medium M conveyed by conveying section 110. In Embodiment 2, as powder supply section 130 has a width larger than that of powder applying section 320, disposing a member to prevent powder P from scattering or a collection member for sucking powder P by air suction (both not shown) can prevent powder P from falling or scattering from conveying member 132 (not shown) by.

Figure 8A:
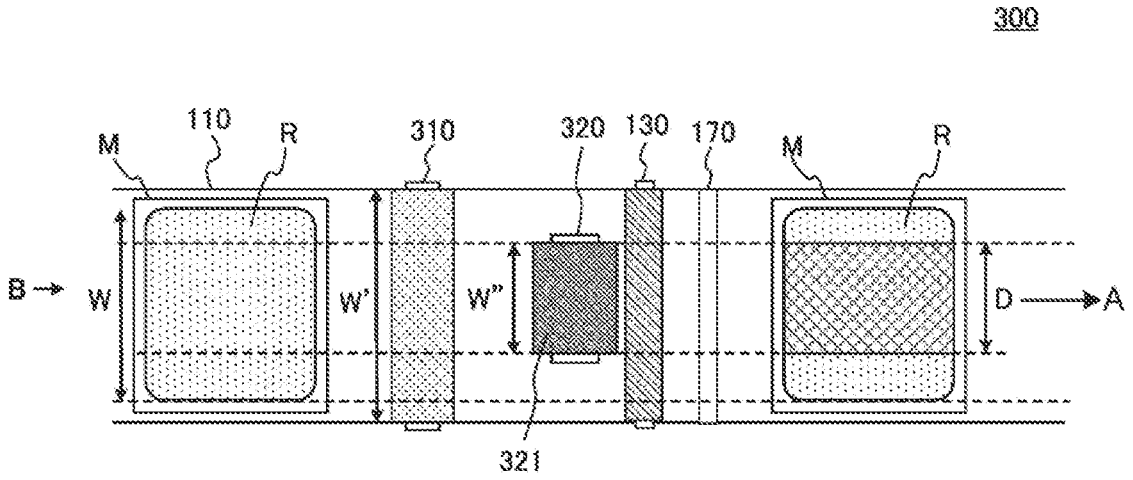
FIGS. 8A and 8B are plan views of the image forming apparatus according to Embodiment 2.
Figure 8B:
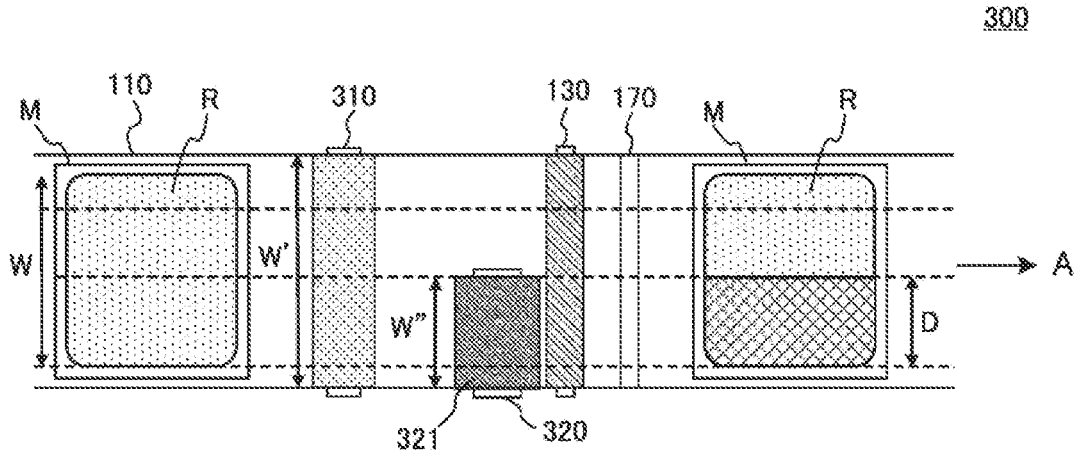

In image forming apparatus 300 according to Embodiment 2, the disposing position of powder applying section 320 may be changed in accordance with the position where image R is desired to be softened (the region (D) where powder P is desired to be adhered) in the width direction, as illustrated in FIGS. 8A and 8B.

Figure 9:
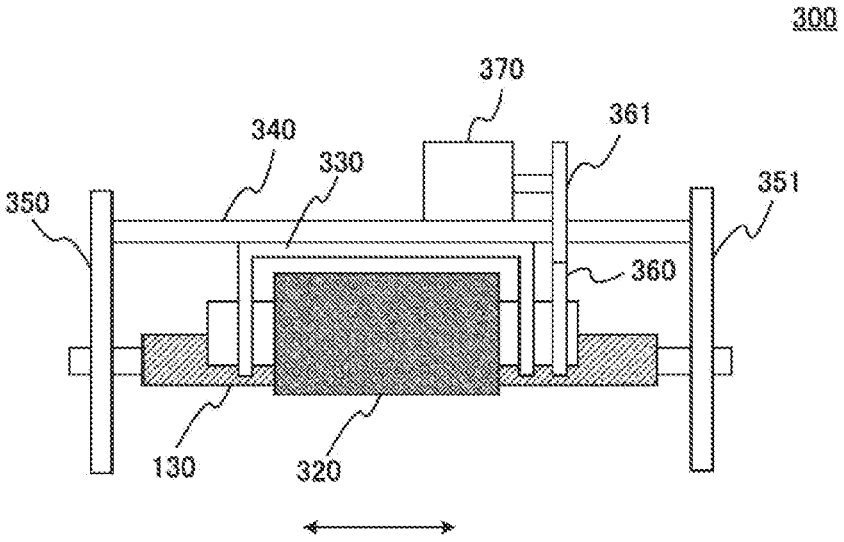
FIG. 9 is a front view of the image forming apparatus as viewed from the B direction of FIG. 8A.

For example, the disposing position of powder applying section 320 can be changed by adopting the configuration as shown in FIG. 9. FIG. 9 is a front view of the image forming apparatus as viewed from direction B of FIG. 8A, and softening section 310 is not shown. Powder applying section 320 is attached to holding frame 330 via a bearing (not shown). Holding frame 330 is attached to support plate 340, and support plate 340 is disposed between side plates 350 and 351. Powder supply section 130 is attached between side plates 350 and 351 via a bearing (not shown). Gear 360 is attached to one end of powder applying section 320 and is connected to gear 361 fixed to drive motor 370 to enable powder applying section 320 to move in the direction of the arrow in FIG. 9. A hole (not shown) is provided in support plate 340 to allow gear 361 fixed to drive motor 370 to pass through, allowing gear 361 to connect to gear 360 attached to powder applying section 320. In this way, moving powder applying section 320 to a region (D) where powder P is desired to be adhered in image R (see FIGS. 7 to 8B) enables the application of powder P supplied from powder supply section 130 to image R. For changing attaching position of powder applying section 320, the attaching position of drive motor 370 should also be changed. However, when drive motor 370 is attached on holding frame 330, the position of powder applying section 320 can be changed simply by changing the position of holding frame 330.

Figure 10A:
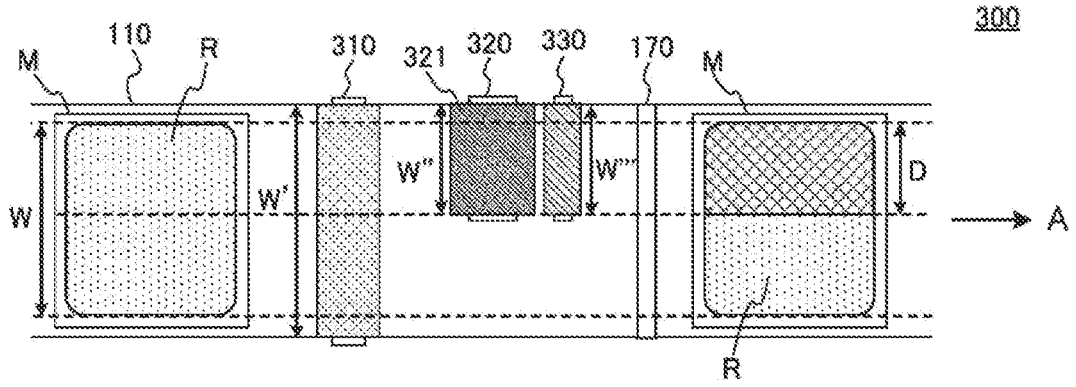
FIGS. 10A to 10C are plan views of an image forming apparatus according to a modification of Embodiment 2.
Figure 10B:
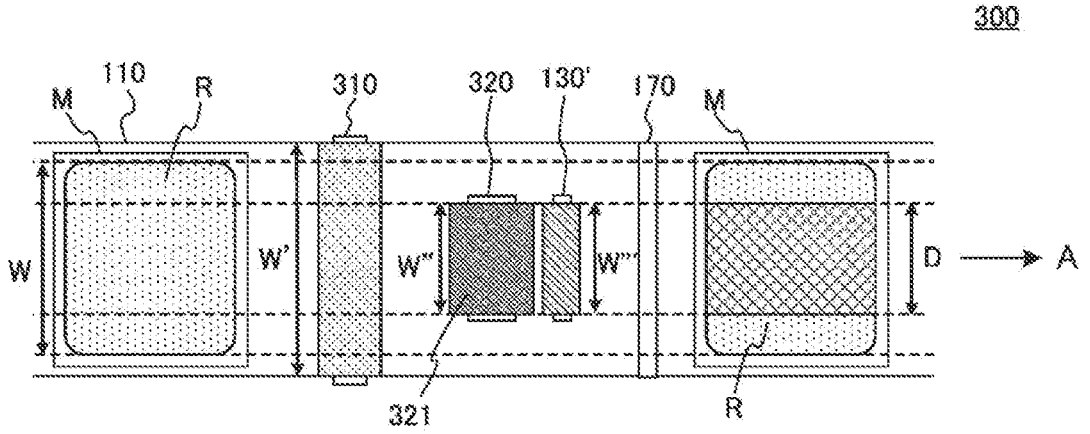
Figure 10C:
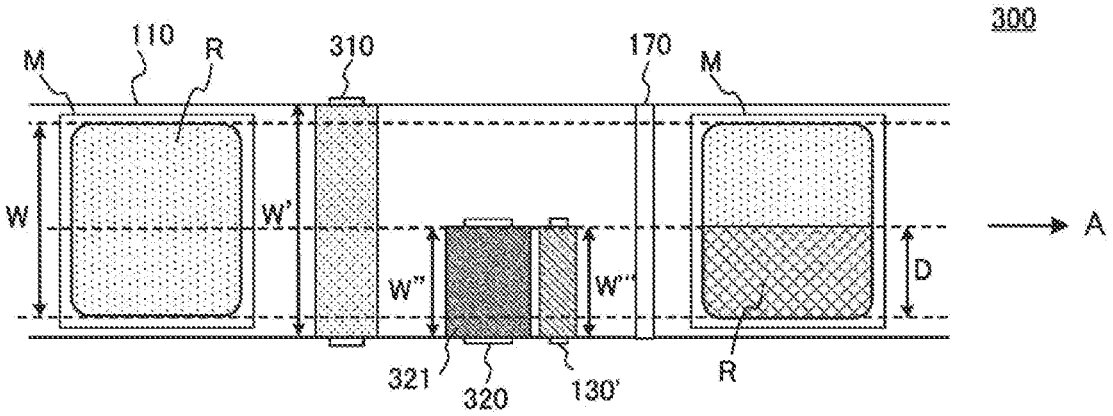

For allowing powder P to adhere to a range that is narrower than the maximum width (W) of image R, the width of powder supply section 130' may be set to a width (W"') the same as the width (W") of powder applying section 320 in image forming apparatus 300 according to Embodiment 2, as illustrated in FIGS. 10A to 10C. In addition, the disposing positions of powder applying section 320 and powder supply section 130' may be changed in accordance with the position where image R is desired to be softened (the region (D) where powder P is desired to be adhered) in the width direction.

Effect

According to Embodiment 2 configured as described above, a range that is narrower than the maximum width (W) of image R can be decorated by using powder applying section 320 having a width (W") smaller than the maximum width (W) of image R in the width direction even when the entire image R is softened. In addition, as powder applying section 320 has the width (W") that is smaller than the maximum width (W) of image R, excess powder P can be prevented from adhering to the surface of image R.

Embodiment 3

Configuration of Image Forming Apparatus

Figure 11:
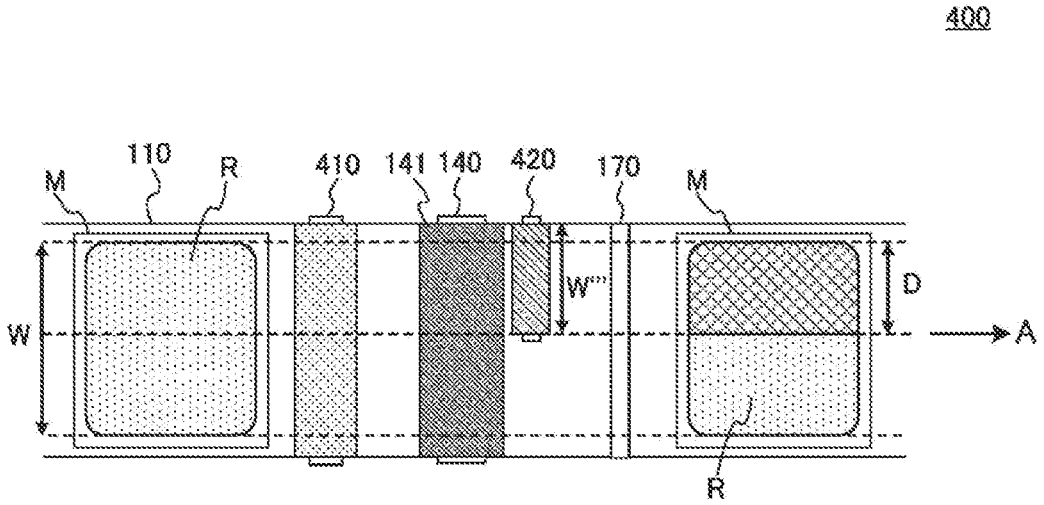
FIG. 11 is a plan view of an image forming apparatus according to Embodiment 3.

FIG. 11 is a plan view of image forming apparatus 400 according to Embodiment 3.

In image forming apparatus 400 according to Embodiment 3, the size of softening section 410 in the width direction in conveyance direction A and the size of powder supply section 420 in the width direction in conveyance direction are different from those of Embodiment 1. Therefore, the same components as those of image forming apparatus 100 according to Embodiment 1 are designated by the same reference numerals, and the description thereof will be omitted.

As illustrated in FIG. 11, image forming apparatus 400 includes conveying section 110 that conveys recording medium M supporting image R in conveyance direction A; softening section 410 that softens image R; powder supply section 420 that supplies powder P; powder applying section 140 that attaches powder P, supplied from powder supply section 420, to powder holding surface 141 to convey powder P, and applies powder P to image R; rubbing section 150 (not shown) that aligns powder P, supplied from powder supply section 420 to powder applying section 140, on the surface of powder applying section 140; opposing member 160 (not shown) which is provided at a position facing powder holding surface 141 of powder applying section 140 with recording medium M between opposing member 160 and powder holding surface 141, and which pressurizes recording medium M and powder P between opposing member 160 and powder applying section 140; and powder collecting section 170 that collects powder P adhering to conveying section 110 and a region other than image R on recording medium M.

Powder supply section 420 supplies powder P to a range—that is narrower than the maximum width (W) of the image R in the width direction—in powder holding surface 141. Powder applying section 140 supplied with powder P causes powder P to adhere to the surface of image R in the supplied range.

Figure 12A:
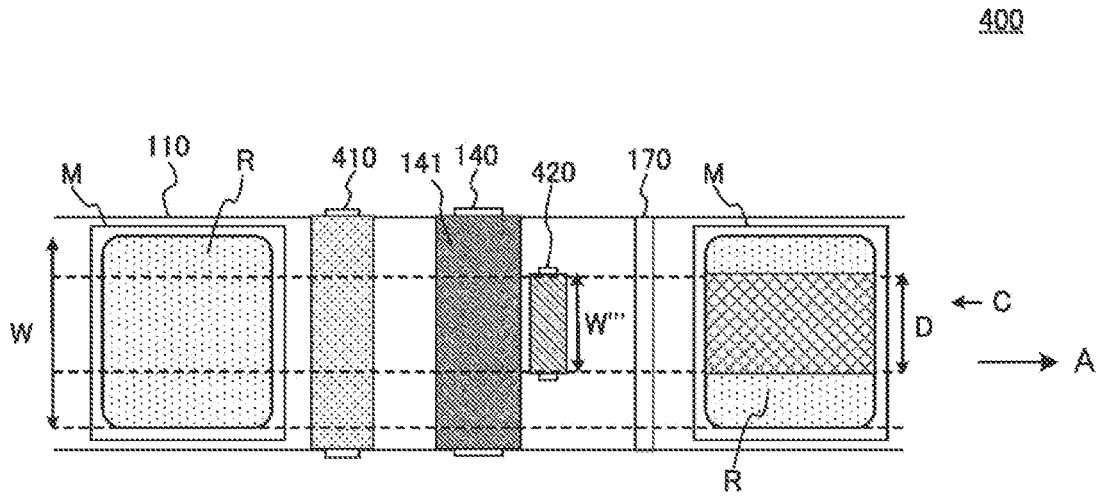
FIGS. 12A and 12B are plan views of the image forming apparatus according to Embodiment 3.
Figure 12B:
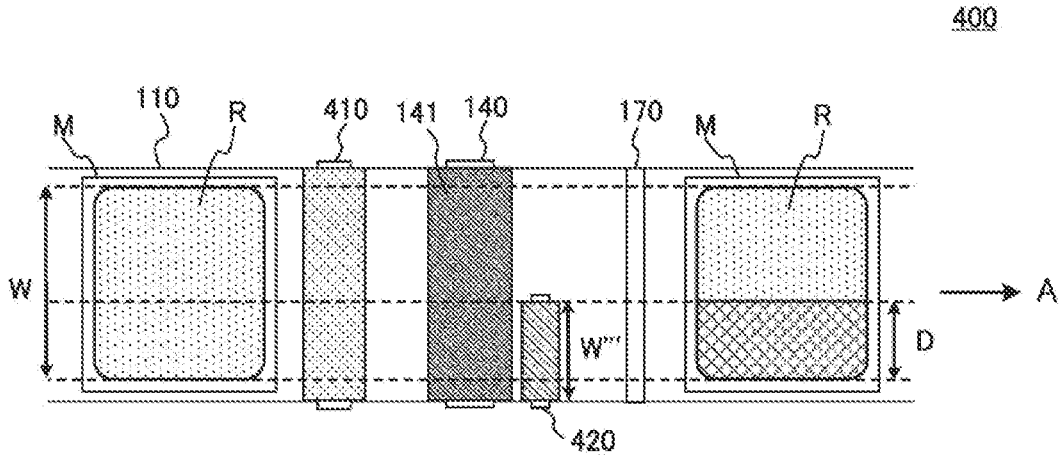

For allowing powder P to adhere to a range that is narrower than the maximum width (W) of image R as illustrated in FIGS. 12A and 12B, the disposing position of powder supply section 420 may be changed in accordance with the position where image R is desired to be softened (the region (D) where powder P is desired to be adhered) in the width direction in image forming apparatus 400 according to Embodiment 3.

Figure 13:
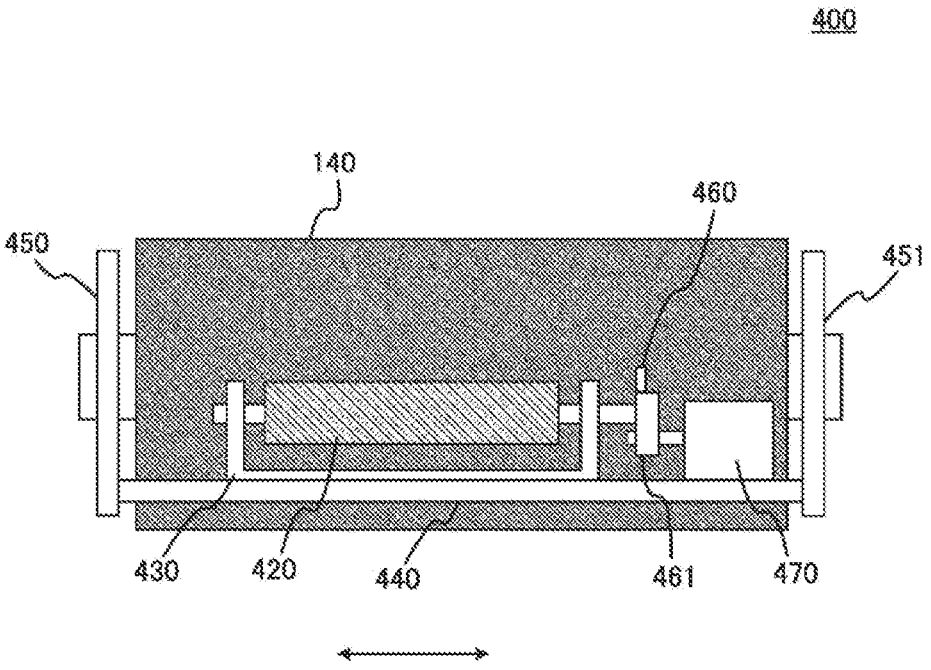
FIG. 13 is a front view of the image forming apparatus as viewed from the C direction of FIG. 12A.

For example, the disposing position of powder supply section 420 can be changed by adopting the configuration as shown in FIG. 13. FIG. 13 is a front view of the image forming apparatus as viewed from the C direction of FIG. 12A, and powder collecting section 170 is not shown. Powder supply section 420 is attached to holding frame 430 via a bearing (not shown). Holding frame 430 is attached to support plate 440, and support plate 440 is disposed between side plates 450 and 451. Powder applying section 140 is attached between side plates 450 and 451 via a bearing (not shown). Gear 460 is attached to one end of powder supply section 420 and is connected to gear 461 fixed to drive motor 470 to enable powder supply section 420 to move in the direction of the arrow in FIG. 13. In this way, moving powder supply section 420 that supplies powder P to a region (D) where powder P is desired to be adhered in image R (see FIGS. 11 to 12B) enables applying powder P to image R. For changing attaching position of powder supply section 420, the attaching position of drive motor 470 should also be changed. However, when drive motor 470 is attached on holding frame 430, the position of powder supply section 420 can be changed simply by changing the position of holding frame 430.

Effect

According to Embodiment 3 configured as described above, a range that is narrower than the maximum width (W) of image R can be decorated by using powder supply section 420 having a width (W"') smaller than the maximum width (W) of image R in the width direction even when the entire image R is softened. In addition, as powder supply section 420 has a width (W') that is smaller than the maximum width (W) of image R, excess powder P can be prevented from adhering to the surface of image R.

Embodiment 4

Configuration of Image Forming Apparatus

Figure 14:
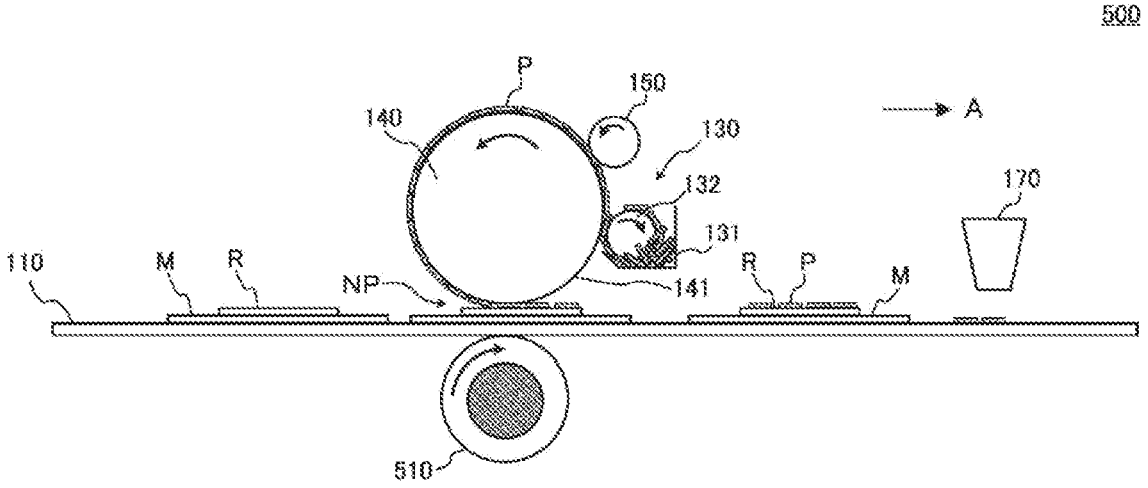
FIG. 14 is a schematic diagram of an overall configuration of an image forming apparatus according to Embodiment 4.

FIG. 14 is a schematic diagram of an overall configuration of an image forming apparatus according to Embodiment 4.

Image forming apparatus 500 according to Embodiment 4 is different from the image forming apparatus of Embodiment 1 in that opposing member 510, which is disposed on the side opposite to powder applying section 140 with recording medium M therebetween and pressurizes recording medium M in conjunction with powder applying section 140, also serves as softening section 120. Therefore, the same components as those of image forming apparatus 100 according to Embodiment 1 are designated by the same reference numerals, and the description thereof will be omitted.

As illustrated in FIG. 14, image forming apparatus 500 includes conveying section 110 that conveys recording medium M supporting image R; powder supply section 130 that supplies powder P; powder applying section 140 that attaches powder P, supplied from powder supply section 130, to powder holding surface 141 to convey powder P, and applies powder P to image R; rubbing section 150 that aligns powder P, supplied from powder supply section 130 to powder applying section 140, on the surface of powder applying section 140; opposing member 510 which is provided at a position facing powder holding surface 141 of powder applying section 140 with recording medium M between opposing member 160 and powder holding surface 141, and which pressurizes recording medium M and powder P between opposing member 160 and powder applying section 140; and powder collecting section 170 that collects powder P adhering to conveying section 110 and a region other than image R on recording medium M.

Powder applying section 140 is a roller that applies powder P to image R while the roller rotates. Opposing member 510 is disposed on the side opposite to a roller (powder applying section 140) with recording medium M therebetween, and pressurizes recording medium M in conjunction with powder applying section 140. In addition, opposing member 510 heats and softens image R supported on the surface of recording medium M, which has been conveyed by conveying section 110 to nip section NR from the back side of recording medium M through conveying section 110.

For allowing powder P to adhere in a range that is narrower than the maximum width (W) of image R in the width direction orthogonal to conveyance direction A of recording medium M, opposing member 510 has a width smaller than the maximum width (W) of image R, which recording medium M can support. Opposing member 510 may be made of any material, as long as opposing member 510 can pressurize recording medium M in conjunction with powder applying section 140 to soften image R. Opposing member 510 may be, for example, a metal roller including a hollow core metal, or a roller including an elastic layer on the outer circumferential surface of a core metal.

In image forming apparatus 500 according to Embodiment 4, powder supply section 130 or powder applying section 140 having a width smaller than the maximum width (W) of image R may be disposed in place of opposing member 510 whose width is smaller than the maximum width (W) of image R. The disposing position of opposing member 510, powder supply section 130 and/or powder applying section 140 may be changed in accordance with the position where image R is desired to be softened (the region (D) where powder P is desired to be adhered) in the width direction.

Effect

According to Embodiment 4 configured as described above, opposing member 510 also serves as the softening section, and thus softening of image R and applying of powder P to the surface of image R can be simultaneously performed. Therefore, even a lowered setting temperature of the softening section is sufficient for causing powder P to adhere. Changing the disposing position and/or width of opposing member 510, powder supply section 130, and/or powder applying section 140 allows powder P to adhere to a desired range in image R and prevents excess powder P from adhering to the surface of image R.

Embodiment 5

Configuration of Image Forming Apparatus

Figure 15A:
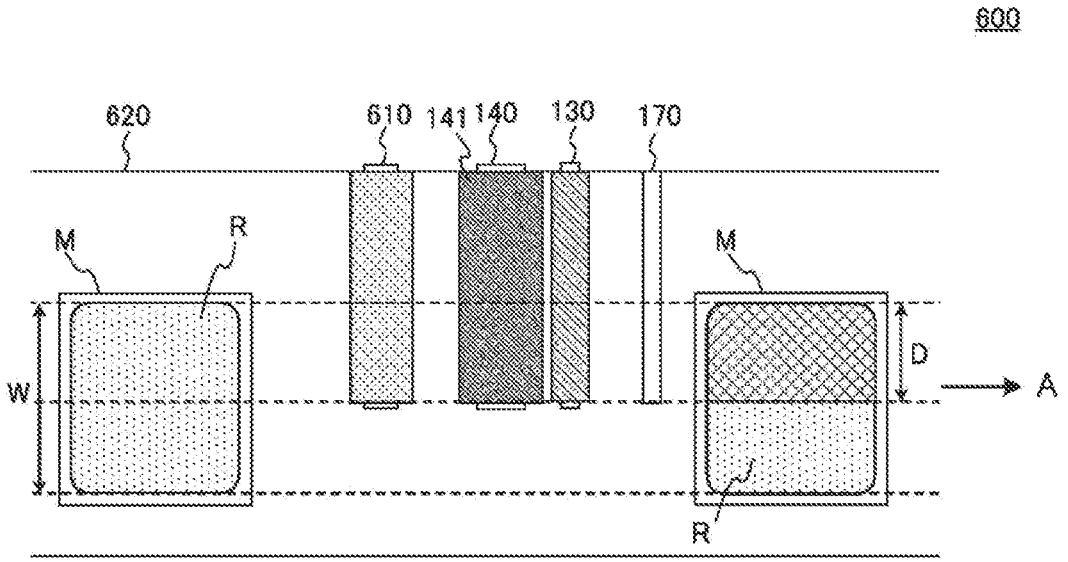
FIGS. 15A and 15B are plan views of an image forming apparatus according to Embodiment 5.
Figure 15B:
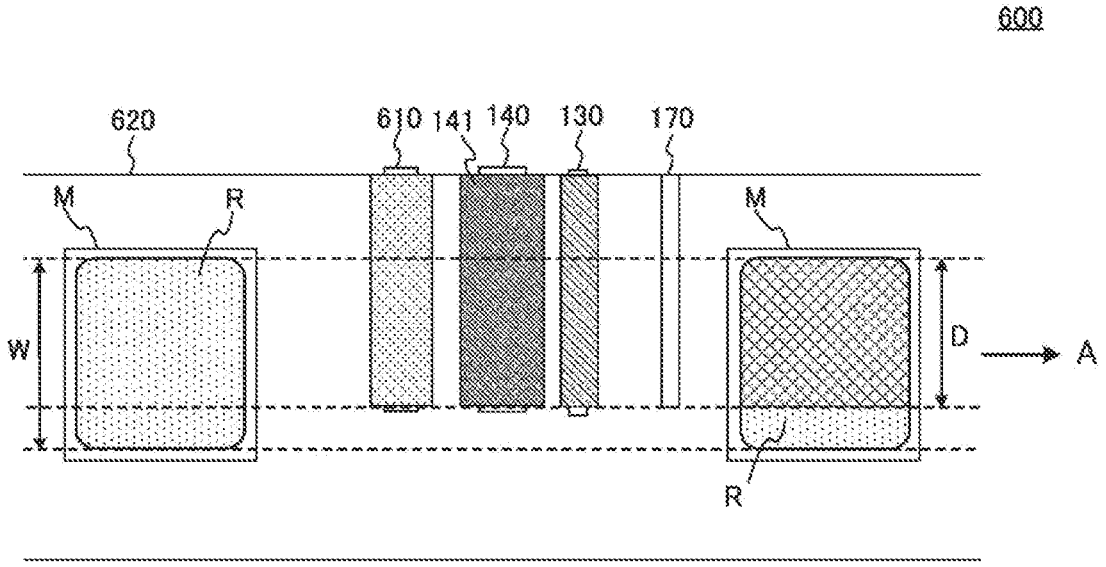

FIGS. 15A and 15B are plan views of image forming apparatus 600 according to Embodiment 5.

In image forming apparatus 600 according to Embodiment 5, the size of softening section 610 in the width direction in conveyance direction A and the size of conveying section 620 in the width direction are different from those of Embodiment 1. Therefore, the same components as those of image forming apparatus 100 according to Embodiment 1 are designated by the same reference numerals, and the description thereof will be omitted.

As illustrated in FIGS. 15A and 15B, image forming apparatus 600 includes conveying section 620 that conveys recording medium M supporting image R in conveyance direction A; softening section 610 that softens image R; powder supply section 130 that supplies powder P; powder applying section 140 that attaches powder P, supplied from powder supply section 130, to powder holding surface 141 to convey powder P, and applies powder P to image R; rubbing section 150 (not shown) that aligns powder P, supplied from powder supply section 130 to powder applying section 140, on the surface of powder applying section 140; opposing member 160 (not shown) which is provided at a position facing powder holding surface 141 of powder applying section 140 with recording medium M between opposing member 160 and powder holding surface 141, and which pressurizes recording medium M and powder P between opposing member 160 and powder applying section 140; and powder collecting section 170 that collects powder P adhering to conveying section 110 and a region other than image R on recording medium M.

In image forming apparatus 600 as illustrated in FIGS. 15A and 15B, conveying section 620 conveys an image to a position such that the range to which powder P adheres becomes narrower in the width direction than the maximum width (W) of image R, which recording medium M can support. In addition, conveying section 620 may change the position to which image R is conveyed in accordance with the position where image R is desired to be softened (the region (D) where powder P is desired to be adhered) in the width direction.

Effect

As conveying section 620 adjusts the position to which recording medium M is conveyed, the range to which powder P adheres can be changed. By changing the position to which recording medium M supporting image R is conveyed, the region where powder P adheres in image R can be adjusted regardless of the size of recording medium M.

Other Embodiments

Modification 1

Configuration of Image Forming Apparatus

Figure 16:
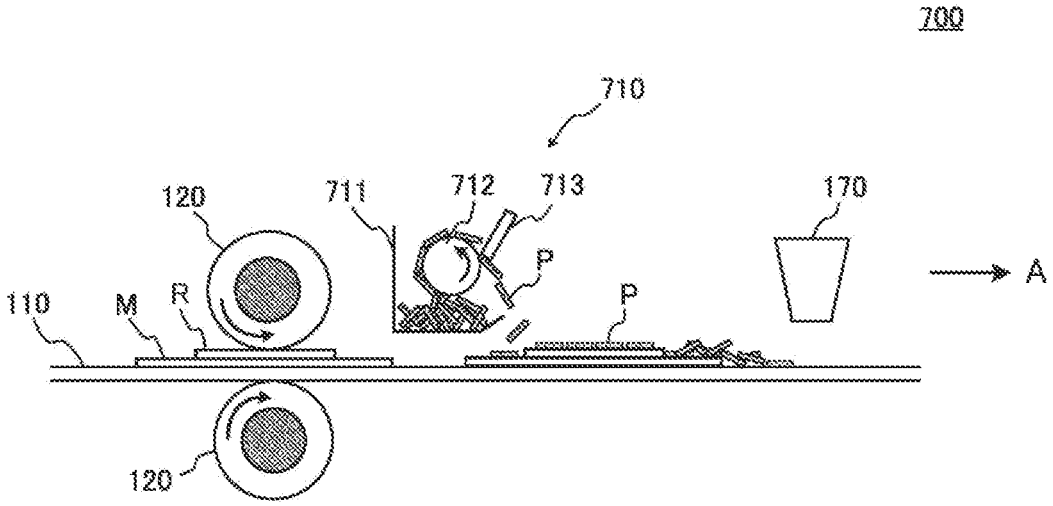
FIG. 16 is a schematic diagram of an overall configuration of an image forming apparatus according to Modification 1.

FIG. 16 is a schematic diagram of an overall configuration of image forming apparatus 700 according to Modification 1.

Image forming apparatus 700 according to Modification 1 is different from the image forming apparatus of Embodiment 1 in that image forming apparatus 700 does not include a powder supply section or an opposing member. Therefore, the same components as those of image forming apparatus 100 according to Embodiment 1 are designated by the same reference numerals, and the description thereof will be omitted.

As illustrated in FIG. 16, image forming apparatus 700 includes conveying section 110 for conveying recording medium M supporting image R in conveyance direction A; softening section 120 for softening image R; powder applying section 710 that supplies powder P; and powder collecting section 170 that collects powder P adhering to conveying section 110 and a region other than image R on recording medium M.

Powder applying section 710 sprays powder P on the surface of recording medium M. Powder applying section 710 includes storage container 711 housing powder P, conveying member 712 that conveys powder P to the opening of storage container 711, and flicker 713 for flicking off powder P held in conveying member 712.

Flicker 713 is a plate-shaped member, and is disposed at a position so as to come into contact with conveying member 712. According to this configuration, powder P held in conveying member 712 that rotates counterclockwise is flicked off by flicker 713 and sprayed on image R supported on the surface of recording medium M. Upon spraying of powder P, image R has been softened by softening section 120 disposed upstream of powder applying section 710. Powder P adheres only to softened image R, and powder P that has not adhered is collected by powder collecting section 170 disposed downstream of powder applying section 710.

For supplying powder P to a portion of image R, the sizes in the width direction and/or the disposing positions of softening section 120 and a powder applying section section may be changed as shown in Embodiments 1 to 5.

Modification 2

Configuration of Image Forming Apparatus

Figure 17:
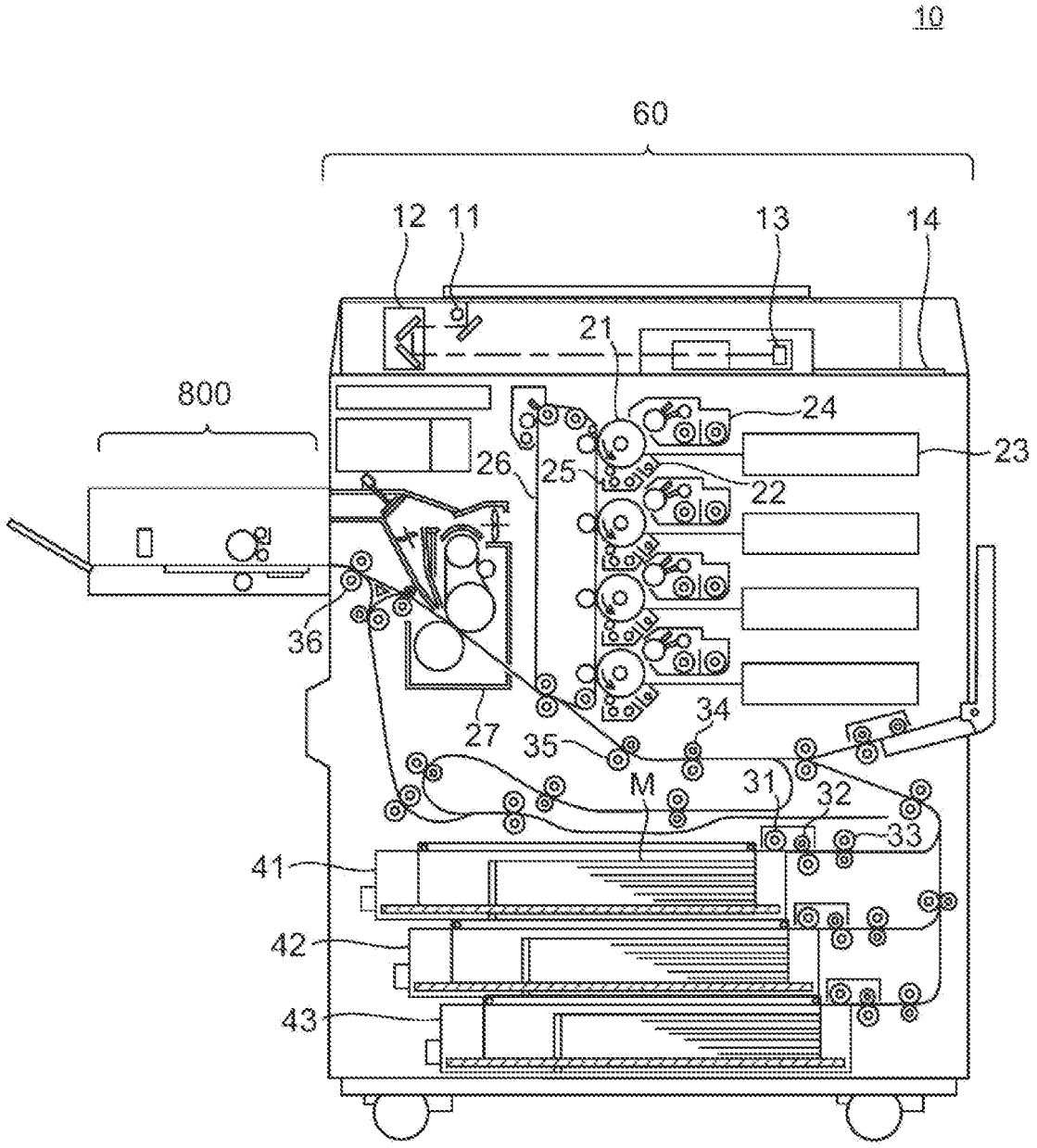
FIG. 17 is a schematic diagram of an overall configuration of an image forming apparatus according to Modification 2.

FIG. 17 is a schematic diagram of an overall configuration of an image forming apparatus according to Modification 2.

Image forming apparatus 10 may include toner image forming section 60 that forms image R in addition to the above described configuration. FIG. 17 is a schematic diagram of an overall configuration of image forming apparatus 10 including toner image forming section 60 that forms image R as a toner image by an electrophotographic method.

Toner image forming section 60 has a structure similar to that of a known color printer that forms a toner image by an electrophotographic method. Toner image forming section 60 includes an image reading section, an image forming section, a recording medium conveying section, a recording medium feeding section, a data receiving section, a control section, and fixing section 27.

The image reading section includes light source 11, optical system 12, imaging device 13, and image processing section 14.

In the image reading section, light emitted from light source 11 is incident on an original placed on a reading surface, and reflected light passes through a lens and is reflected by a reflecting mirror of optical system 12 to be imaged on imaging device 13 having moved to a reading position. Imaging device 13 generates an electric signal in accordance with the intensity of the reflected light from the original. The thus generated electric signal of an analog signal is converted into a digital signal in image processing section 14, then subjected to correction processing, filter processing, image compression processing, and the like, and stored in a memory of image processing section 14 as image data. In this manner, the image reading section reads an image of an original to store image data thereof.

The image forming section includes an image forming section for forming an image of a yellow (Y) toner, an image forming section for forming an image of a magenta (M) toner, an image forming section for forming an image of a cyan (C) toner, an image forming section for forming an image of a black (K) toner, and intermediate transfer belt 26. Herein. Y, M, C and K corresponds to the colors of toners.

Each image forming section includes photoconductor drum 21 (a rotating member), and charging section 22, optical writing section 23, developing device 24, and drum cleaner 25 disposed around the photoconductor drum. Intermediate transfer belt 26 is wound around a plurality of rollers and thus is supported so as to be able to run.

Photoconductor drum 21 is rotated at a prescribed speed by a drum motor. Charging section 22 charges the surface of photoconductor drum 21 to a desired potential. Optical writing section 23 writes, based on the image data, an image information signal on photoconductor drum 21, and forms a latent image based on the image information signal on photoconductor drum 21. The latent image is then developed by developing device 24, and a toner image, that is, a visible image, is formed on photoconductor drum 21. In this manner, unfixed toner images of yellow, magenta, cyan and black colors are respectively formed on photoconductor drums 21 of the Y, M, C and K image forming sections. Through the process described above, the image forming section forms the toner image by employing electrophotographic image forming process.

The toner images of the respective colors formed by the Y, M, C and K image forming sections are successively transferred by a primary transferring section onto running intermediate transfer belt 26. A color toner image including toner layers of yellow, magenta, cyan, and black colors superimposed on one another is thus formed on intermediate transfer belt 26.

In the recording medium conveying section, recording medium M is fed to the conveyance path one by one from recording medium feed tray 41, 42 or 43 of the recording medium feeding section by feed roller 31 and separation roller 32. Recording medium M fed to the conveyance path is conveyed along the conveyance path by conveyance roller 33 through loop roller 34 and registration roller 35 to a secondary transfer roller. The color toner image on intermediate transfer belt 26 is then transferred onto recording medium M.

Applying heat and pressure at fixing section 27 to recording medium M including the color toner image transferred thereon fixes the color toner image on recording medium M as a color toner layer on recording medium M. A resin image including a resin layer is thus formed on recording medium M. The resin image including a resin layer formed on recording medium M is fed to image forming apparatus 100 (surface treating section) according to Embodiment 1 through recording medium ejection roller 36.

The control section includes a CPU (Central Processing Unit), a RAM (Random Access Memory) and a ROM (Read Only Memory). The CPU controls, in accordance with programs stored in the ROM, the image reading section, the image forming section, the recording medium conveying section, the recording medium feeding section and the surface treating section, and stores operation results and the like in the RAM. In addition, the control section performs control to analyze print data externally received to generate image data in a bit map format, and to form an image based on the image data on recording medium M. The programs include a program for adjusting a supply amount of a softener in the surface treating section and a program for setting rubbing conditions.

In addition, the control section transmits/receives, through a communication section (not shown), various data to/from an external apparatus (such as a personal computer) connected to a communication network such as a LAN (Local Area Network) or WAN (Wide Area Network). The control section receives, for example, image data transmitted from an external apparatus, or input data on a decorated image to be formed received by the data receiving section, and allows an image to be formed on recording medium M based on this image data (or input image data). The communication section is composed of a communication control card such as a LAN card.

The image formed by toner image forming section 60 is conveyed to image forming section 800 (as decorated image forming section) and decorated.

The above embodiments are merely examples of embodiments in implementing the present invention, and the technical scope of the present invention shall not be interpreted in a limited manner by the above embodiments.

The invention can be implemented in various ways without deviating from its scope or its main features.

INDUSTRIAL APPLICABILITY

The present invention is capable of suitably applying powder for forming a decorated image on the surface of a resin layer. Accordingly, the present invention is suitable as an image forming apparatus for forming decorative images.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus, comprising:

a conveyer that conveys a recording medium supporting an image;

a softener that softens the image; and a powder applicator that applies powder to a surface of the softened image, wherein the applied powder adheres to a range that is narrower in a width direction orthogonal to a conveyance direction of the recording medium conveyed by the conveyer than a maximum width of the image to be supported by the recording medium.

2. The image forming apparatus according to claim 1, wherein the softener softens the image in a range that is narrower in the width direction than the maximum width of the image to be supported by the recording medium.

3. The image forming apparatus according to claim 2, wherein a position of the softener for softening the image in the width direction is changeable.

4. The image forming apparatus according to claim 2, wherein the softener includes a plurality of softeners disposed at different positions in the width direction.

5. The image forming apparatus according to claim 1, wherein the powder applicator applies the powder in a range that is narrower in the width direction than the maximum width of the image to be supported by the recording medium.

6. The image forming apparatus according to claim 5, wherein a position of the powder applicator for applying the powder in the width direction is changeable.

7. The image forming apparatus according to claim 5, wherein the powder applicator includes:

a powder holder that holds the powder to be applied to the image; and a powder supplier that supplies the powder to the powder holder, wherein the powder supplier supplies the powder in a range that is narrower in the width direction than the maximum width of the image to be supported by the recording medium, the range being in the powder holder.

8. The image forming apparatus according to claim 1, wherein the conveyer conveys the image to a position such that a range to which the powder adheres becomes narrower in the width direction than the maximum width of the image to be supported by the recording medium.

9. The image forming apparatus according to claim 8, wherein the conveyer changes a position to which the image is conveyed so as to change the range to which the powder adheres.

10. The image forming apparatus according to claim 1, wherein:

the powder applicator is a roller that applies the powder to the image while the roller rotates, and the image forming apparatus further includes an opposing member disposed on a side opposite to the roller with the recording medium between the opposing member and the roller, the opposing member pressurizing the recording medium in conjunction with the roller.

11. The image forming apparatus according to claim 10, wherein the opposing member heats and softens the image.

12. The image forming apparatus according to claim 1, wherein the powder applicator sprays the powder on the surface of the softened image.

* * * * *